6/26/84 XR 4,456,910

United States Patent [19]

DiMassimo et al.

[11] 4,456,910

[45] Jun. 26, 1984

[54] NON-COMPLEMENTARY METAL OXIDE SEMICONDUCTOR (MOS) DRIVER FOR LIQUID CRYSTAL DISPLAYS

[75] Inventors: Donald V. DiMassimo; John B. May, both of Liverpool, N.Y.

[73] Assignee: General Electric Company, Syracuse, N.Y.

[21] Appl. No.: 407,402

[22] Filed: Aug. 12, 1982

[51] Int. Cl.[3] ..... G09G 3/18

[52] U.S. Cl. ..... 340/784; 340/765; 340/811; 340/813; 350/332

[58] Field of Search ..... 340/765, 784, 811, 813, 340/718; 350/332, 333

[56] References Cited

U.S. PATENT DOCUMENTS

| | | | |
|---|---|---|---|
| 3,794,990 | 2/1974 | Kishimoto | 340/811 |
| 3,936,676 | 2/1976 | Fujita | 340/811 |
| 4,019,178 | 4/1977 | Hashimoto et al. | 350/332 |
| 4,040,721 | 8/1977 | Kurita | 340/784 |
| 4,050,064 | 9/1977 | Hashimoto et al. | 340/811 |
| 4,060,802 | 11/1977 | Matsuki | 340/765 |
| 4,099,073 | 7/1978 | Hashimoto et al. | 340/811 |
| 4,245,168 | 1/1981 | Waldron | 340/784 |
| 4,395,708 | 7/1983 | Lloyd | 340/784 |

*Primary Examiner*—Gerald L. Brigance
*Attorney, Agent, or Firm*—Richard V. Lang

[57] ABSTRACT

The present invention relates to a PMOS or NMOS driver for a liquid crystal display. The driver is designed for ac excitation of the display with a minimum dc component, and with minimum excitation of "off" segments for optimum display performance. The drive circuitry includes a pair of larger capacity drivers, which exhibit alternate high and low output states, between which the individual segments and the backplane of the display are connected for ac excitation. A pair of lower capacity switches are provided in association with each segment. The first lower capacity switch connects the segment to be activated to one of the drivers, and a second switch, maintained in a state alternate to that of the first switch, disconnects that segment from the backplane. When the segment switches are turned on strongly, as by a voltage doubling input circuit, the desired LCD driver performance is achieved using a non-complementary design of lower cost than the conventional CMOS driver.

6 Claims, 11 Drawing Figures

NON-COMPLEMENTARY METAL OXIDE SEMICONDUCTOR (MOS) DRIVER FOR LIQUID CRYSTAL DISPLAYS

BACKGROUND OF THE INVENTION

1. Field of the Invention

The invention relates to integrated circuits for operating liquid crystal displays, and more particularly to a liquid crystal display driver using a non-complementary metal oxide semiconductor (MOS) integrated circuit structure.

2. Description of the Prior Art

It is known that to obtain long life, a high contrast ratio, and minimal "ghosting", a liquid crystal display (LCD) must be driven with a carefully characterized ac voltage. In particular, the ac voltage should assume a substantially zero value for non-illuminated portions of the display. The presence of a small ac or dc voltage, for instance in excess of 0.05 volts, may cause the appearance of "ghosts"—or dimly activated segments in the non-activated portions of the display. In addition, if in the operation of the segments, a dc component persists on the segments, there will be a gradual loss of clarity in the display. These requirements are somewhat more severe for liquid crystal displays utilizing a colored dye dichroic material to which the present drivers have application. The dichroic liquid crystal displays have somewhat lower thresholds and require higher RMS drive voltages.

In general LCD driving circuits, where the cost of the IC need not be minimized, it is conventional for the LCD driver to be constructed with a Complementary Metal Oxide Semiconductor (CMOS) Field Effect Transistor (FET) process.

In a complementary driver PMOS and NMOS devices may be used to drive each side of the display to the plus and minus power supplies respectively on alternating cycles so that there is a negligible dc component in the ac activation provided to the active segments of the display. In short, the performance of the complementary MOS drivers can be very good, but at a cost which is substantially greater than that of a non-complementary (NMOS or PMOS) integrated circuit.

Known non-complementary integrated driving circuitry for LCD displays has often required compensatory features to be functional, such as discrete backplane capacitors to block dc. Often oversized drivers for each of the segments have been required resulting in both excessive chip areas and excessive power demands. A recurrent problem with non-complementary display drivers has been the appearance of "ghosts" in off segments and the presence of some average level of dc which has tended to reduce the clarity of the display. The present invention seeks to provide non-complementary (PMOS or NMOS) drive circuitry, which avoids the problems of past non-complementary LCD drive circuitry, and has a performance comparable to that of complementary (CMOS) drive circuitry.

SUMMARY OF THE INVENTION

Accordingly, it is an object of the present invention to provide an improved non-complementary driving circuit for a liquid crystal display.

It is another object of the invention to provide an improved non-complementary driving circuit for a liquid crystal display in which the direct current component in both active and inactive portions of the display is minimized.

It is still another object of the invention to provide an improved non-complementary driving circuit for a liquid crystal display of optimum electrical performance while requiring minimum "chip" area and minimum processing complexity.

These and other objects of the invention are achieved in an integrated circuit for operating a segmented liquid crystal display, the plural segments operating in conjunction with a common back plane.

The integrated circuit is provided with a first and a second terminal for connection to a bias supply, the second terminal being connected to a source bus on the IC for application of a supply reference potential (Vss), and the first terminal being connected to a drain bus on the IC for application of the supply potential (Vdd).

The integrated circuit also includes an n-fold plurality of output terminals for connection to individual segments of the LCD display, and a single output terminal for connection to the back plane of the LCD display.

The driving circuitry includes first and second larger capacity FET drivers of like conductivity polarity, (i.e., all PMOS or all NMOS), each FET driver having an input terminal for connection to a periodic input signal, and an output terminal at which a periodic output appears, alternating between near the supply (Vdd) and near reference (Vss) potentials under load. Each FET driver consists of an output FET having its principal electrodes connected between the driver output terminal and the second supply terminal; and an internal load connected between the first supply terminal and the driver output terminal. The output terminal of the first driver is connected to the backplane terminal. In addition, means are provided for coupling an alternating signal to the input of the first and second drivers, the signal being coupled to the first driver in a phase inverse to that coupled to the second driver so as to establish an alternating potential between the output terminals of the drivers.

The driving circuitry further includes an n-fold plurality of FET segmental switching means of lower capacity than the drivers and proportioned for operation of an individual segment. Each segment switching means, in the exemplary embodiment, consists of a first switch, serially connected between the second driver and the segment, and a second switch connected between the segment and the backplane of the display. Each segment is activated by disconnection from the backplane, and by connection to the second driver output terminal. Each segment is inactivated by connection to the backplane and by disconnection from the second driver output terminal.

The foregoing arrangement suppresses any ac or dc component in energization of the display segments which are in an off condition, and holds the dc content of the ac excitation of the active segments to a minimum.

In a preferred form of the invention, the first and second higher capacity FET drivers are push-pull depletion mode drivers. In order to achieve a high conductance "on" state for the segmental switching means a voltage doubling control amplifier is provided for each switch by means of which a voltage substantially equal to twice the supply potential is applied to the gates of the segment switches.

BRIEF DESCRIPTION OF THE DRAWINGS

The novel and distinctive features of the invention are set forth in the claims appended to the present application. The invention itself, however, together with further objects and advantages thereof may best be understood by reference to the following description and accompanying drawings in which:

FIG. 3A is a simplified electrical representation of the driving circuitry for a typical display segment; FIG. 3B is a simplified equivalent circuit representation of the driving circuitry for the display segment; FIG. 3C illustrates the balancing of the electrical drive to the display segment to eliminate any dc component; and FIG. 3D is a graph of the principal waveforms useful in understanding the operation of a single display segment;

DESCRIPTION OF THE PREFERRED EMBODIMENTS

Figure 1:
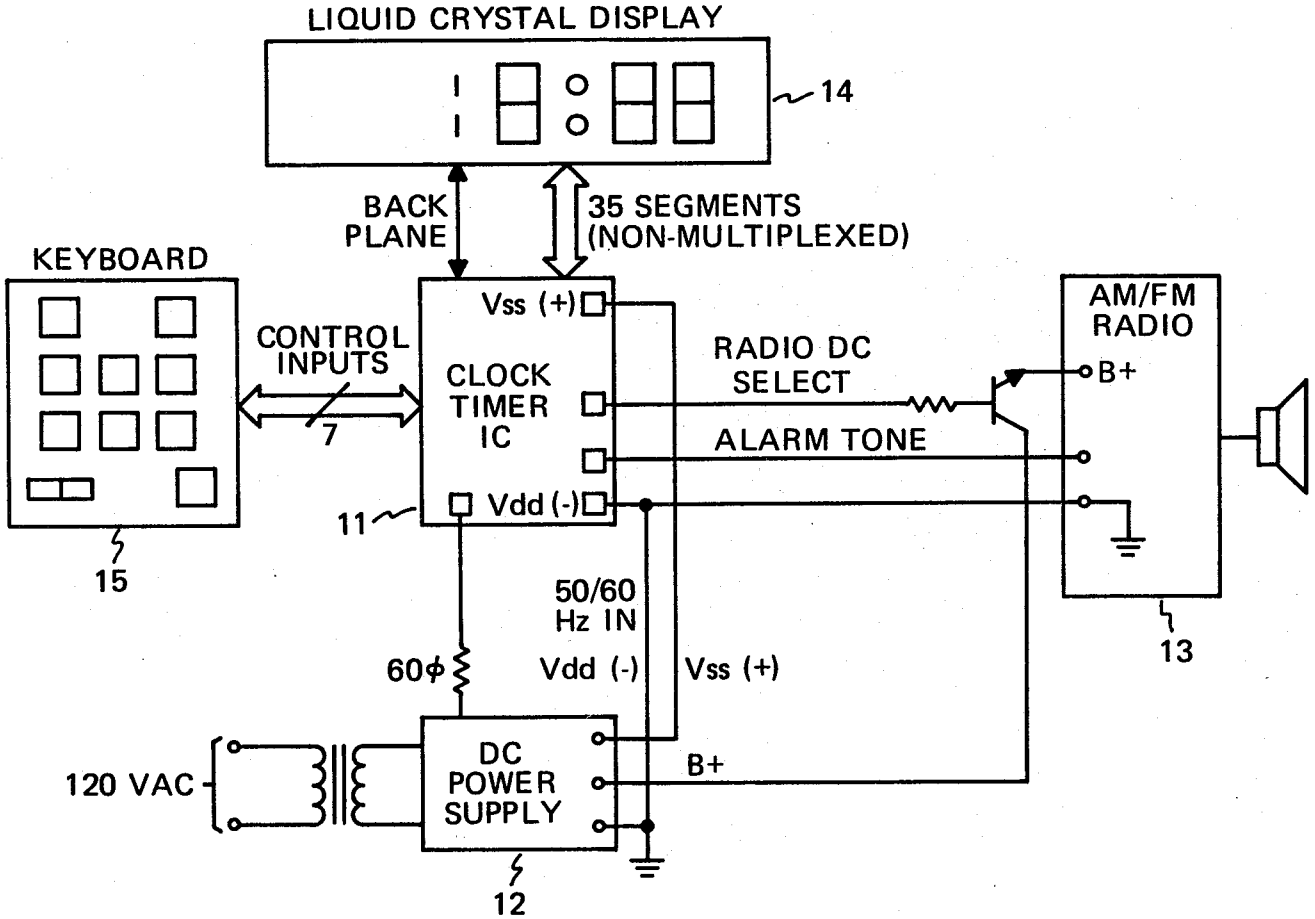
FIG. 1 is a block diagram of a clock radio featuring an electrically driven liquid crystal display which is operated from a clock timer integrated circuit incorporating novel driving circuitry.

FIG. 1 illustrates a clock radio incorporating a liquid crystal display, operated by novel display driving circuitry contained in a low cost integrated circuit. The novel display driving circuitry is contained in the clock timer integrated circuit shown at 11. The clock radio is powered by the dc power supply 12, transformer coupled to a 120 V ac main. The power supply supplies a reduced ac voltage for timing purposes to the clock timer IC, a dc voltage for operating the AM-FM radio 13, and a dc voltage for operating the clock timer IC. The power supply output terminal with a "B+" symbol is connected through a transistor switch to the B+ bus terminal on the AM radio. Both the power supply ground and AM-FM radio ground are connected together. The dc voltage for operating the clock timer IC appears between the power supply terminals with the "Vss" and "Vdd" legends. On the clock timer IC, the Vdd bus is connected to system ground and the substrate and Vss bus are connected to the supply terminal of the dc power supply with the Vss legend.

The clock timer IC, which performs both timing and control functions and which operates the LCD display 14, is controlled by a user operated keyboard 15. The keyboard 15, coupled to the IC, is used to control the clock radio for such purposes as setting the clock, setting the alarm, activating various features of the clock, etc. Finally, the IC operates the liquid crystal display 14, which displays the time and the mode settings of the AM-FM radio. Typically, the display is a 35 segment display operated by connection to 32–35 segment pads and a back plane pad on the perimeter of the clock timer IC. Except for display driver circuitry in the clock timer IC, the overall arrangement is not a part of the present invention, but is illustrated to show one useful application of the present invention.

In the interests of achieving lower cost, the clock timer IC uses a P-MOS FET process by which is meant a p-channel Metal Oxide emiconductor Field Effect Transistor process. This "non-complementary" process is of lower cost than a "complementary" process (CMOS). The complementary MOS process typically entails using an n-channel substrate into which "p wells" are formed so that p-channel and n-channel devices may co-exist on the IC. The additional processing steps add significantly to the costs of the IC. When a lower cost non-complementary p-channel process is employed as herein described, the drain potential (Vdd) is maintained at a negative potential with respect to the substrate potential (Vss). The invention is equally applicable to NMOS fabrication, in which case the power supply connections to the IC would be reversed to invert the sense of the potential between Vdd and Vss busses on the integrated circuit.

Figure 2:
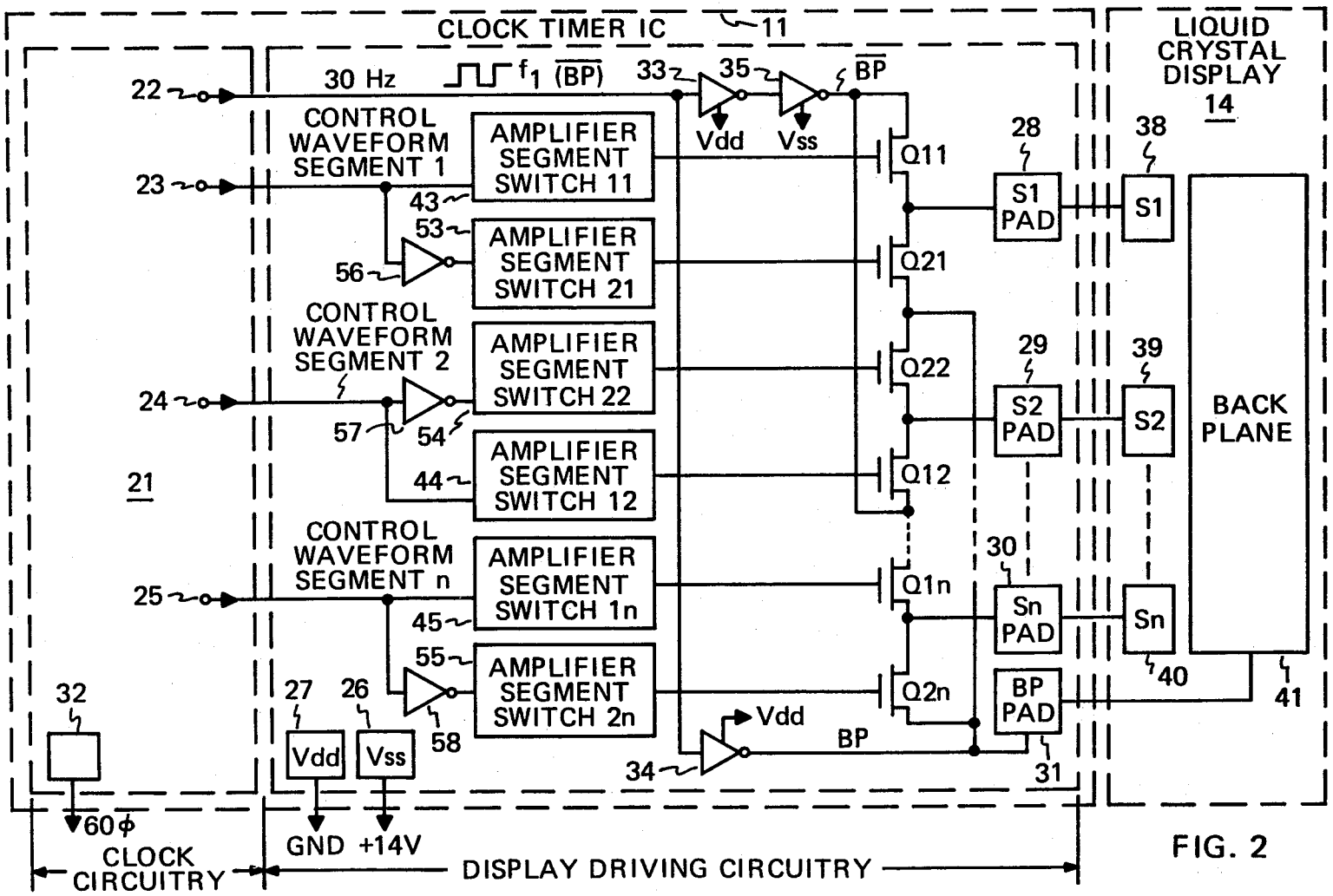
FIG. 2 is an electrical diagram showing the clock timer integrated circuit and associated liquid crystal display, featuring the display driving circuitry of the integrated circuit and the interconnection of the driving circuitry to the liquid crystal display.

FIG. 2 illustrates the liquid crystal display 14 and those portions of the clock timer IC relevant to operating the liquid crystal display. More particularly, the clock circuitry is illustrated as an empty block 21 having a dashed outline lying within the outline of the IC. At the right margin of the block 21, a succession of internal terminals 22–25 are provided, at which waveforms appear for control of the display driving circuitry. These waveforms include a waveform, $\overline{BP}'$ (i.e., the inverse of the back plane waveform) appearing at terminal 22 and a succession of segment control waveforms appearing at terminals 23, 24, 25, etc.) for each of the segments (1 to n) of the display. The backplane waveforms (BP and its inverse $\overline{BP}$) and the waveforms associated with the $i^{th}$ segment are illustrated in FIG. 3D. The waveform $\overline{BP}$ is a rectangular pulse operating between 0 volts and Vdd (−14 volts) at a 30 hertz repetition rate with a 50% duty cycle. The $i^{th}$ segment control waveform is a waveform sustained at Vdd for the period that the $i^{th}$ segment is to be active, and at 0 volts for the period that the $i^{th}$ segment is to be inactive. The on times of segments allocated to the (unit) minutes position on the display have a shorter duration that the segments allocated to the tens of minutes position. The minutes display positions have a shorter duration than the hour positions, etc. The internal timing of the clock circuitry of the IC is derived from the 120 volt ac power line via the low voltage ac tap coupled to pad 32 on the IC.

The display driving circuitry is illustrated as lying within a dashed outline to the right of the clock circuitry, and lying within the larger dashed outline designated for the clock timer IC. The pads 26 and 27 supply dc energization (not elsewhere noted) to the driving and clocking circuitry on the IC. The control waveforms, as noted above, are provided from clock circuitry via the internal terminals 22, 23, 24 and 25 to the driving circuitry. The display driving circuitry on the IC consists of two larger capacity inverting drivers (or buffers) 34, 35 suitable for operating the display as a whole; an inverter 33 at the input of the second driver (35); a first plurality of lower capacity activating segment switches (Q11, Q12, . . . $Q_{1i}$ . . . $Q_{1n}$) and a second plurality of lower capacity inactivating segment switches (Q21, Q22, . . . $Q_{2i}$ . . . $Q_{2n}$) suitable for operating the individual segments; and a twofold plurality of segment switch amplifiers (43–45, activating; 53–55, inactivating). The driving circuitry, timed by the clock circuitry, provides operating potentials via the output pads 28, 29 and 30 to the segments 38, 39 and 40 of the liquid crystal display and via the output pad 31 to the back plane 41 of the display.

The display driver circuitry provides ac exitation (at approximately 14 volts RMS amplitude) for the active segments of the liquid crystal display and near zero exitation (<0.05 volts) for the inactive segments. The output waveform of the display driving circuitry for the $i^{th}$ segment is the $i^{th}$ output waveform (h−i) illustrated in FIG. 3D. It consists of a succession of rectangular pulses having alternately −V and +V amplitude, with 50% duty cycle and a 30 cycle per second repetion rate. The duration of the $i^{th}$ segment output waveform is equal to the duration of the active (0 V) portion of the $i^{th}$ segment control waveform. When the $i^{th}$ segment control waveform goes to an inactive (−V) state, the inactive segment is maintained in an inactive state against the possibility of undesired activation by interconnecting it to the back plane. This function is performed by the inactivating segment switches (Q21–Q2n) and the associated amplifiers (53–55) deriving their control information through the inverters 56–58 from terminals 23–25 respectively. These interconnections through the inverters (56–58) cause the inactivating segment switches (Q21–Q2n) to assume opposite states from the activating segment switches (Q11–Q1n), and to be conductive when a segment is "on" or active and non-conductive when a segment is "off" or inactive.

The inactivating switches maintain the voltage between each inactive segment and back plane below 0.05 volts, and prevent the occurrence of unwanted "ghosts" in the display. As has been stressed, the ac drive circuitry is carefully balanced such that any dc component is negligibly small, irrespective of the number of segments which are active, preventing electrolytic plating of the liquid crystal display material.

The operation of the driver circuits, with further circuit details on both the activating and inactivating segment switches will now be taken up with further reference to FIGS. 3A–3D.

Figure 3A:
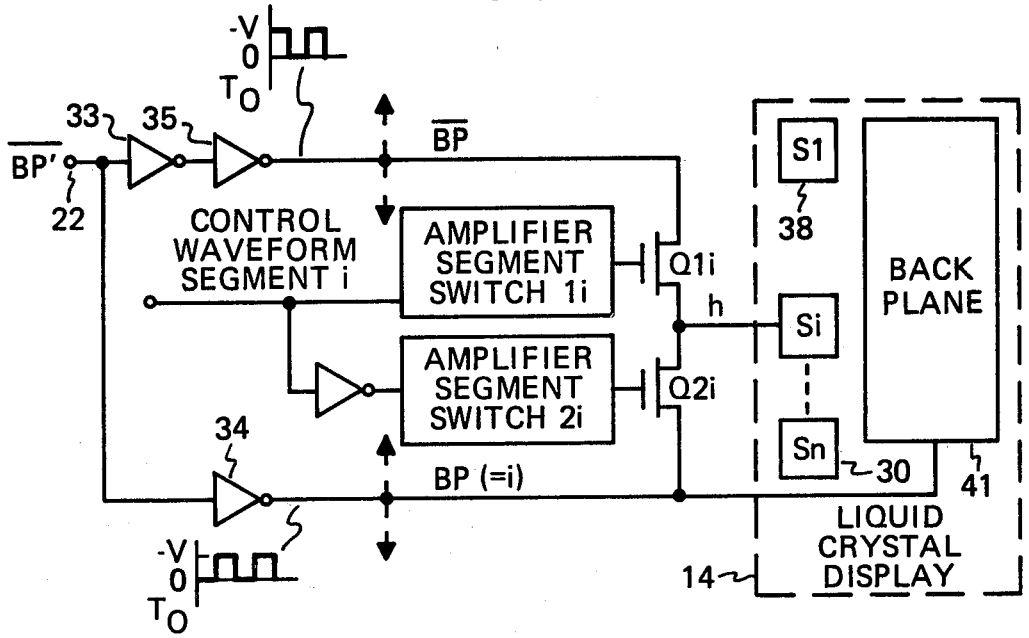
FIGS. 3A, 3B, 3C and 3D deal primarily with operation of a single segment of the display.

FIG. 3A is a simplified electrical representation of the driving circuitry associated with a single "$i^{th}$" segment. The inverter 33 and larger capacity inverter driver 35 on the IC receive the 30 hertz $\overline{BP}'$ waveform, derived from the clock circuitry terminal 22 and reproduce the $\overline{BP}$ waveform (see FIG. 3D), coupling it to one principal electrode of the segment activating switch $Q_{1i}$. The other principal electrode of $Q_{1i}$ is connected to the $i^{th}$ segment on the LCD display 14. The large capacity inverting driver 34 also receives the 30 hertz $\overline{BP}'$ waveform derived from the terminal 22 and couples its inverse (BP) to the back plane 41 of the liquid crystal display 14. The segment activating switch $Q_{2i}$ has one principal electrode connected to the $i^{th}$ segment and the other principal electrode connected to the back plane 41. The activating segment switch $Q_{1i}$ has its gate coupled via segment switch Amplifier 1i to a terminal providing the control waveform for the $i^{th}$ segment as shown in FIG. 3D. The inactivating segment switch $Q_{2i}$ has its gate coupled to the output of the Amplifier 2i, whose input is coupled via an inverter to the terminal of the clock circuitry providing the segment i control waveform (see FIG. 3D). The waveform appearing at the $i^{th}$ segment is the waveform h of FIG. 3D, which reflects both the 30 hertz content of the $\overline{BP}$ waveform and the $i^{th}$ segment control information for setting the durations of the two output states. The waveform appearing at the back plane is the i waveform of FIG. 3D unaffected by the segment control information. These two waveforms (h,i) combine to form the output waveform (h−i) which appears between the $i^{th}$ segment and the back plane. The output waveform (h−i) has a voltage which alternates between −V and +V in the first output state, when the $i^{th}$ segment is on. In the second output state, when the $i^{th}$ segment is off, the output waveform is at zero volts.

The creation of the waveforms h, i and (h−i) may be further explained with additional reference to FIG. 3A. The activating segment switch $Q_{1i}$ connects the $i^{th}$ segment to the output of the buffer amplifier at which $\overline{BP}$ appears, when the gate of $Q_{1i}$ is turned on. Meanwhile, the inactivating segment switch $Q_{2i}$, whose gate receives an inverted instruction, disconnects the $i^{th}$ segment from the back plane. When the segment control signal goes off to inactivate segment i, the activating switch $Q_{1i}$ becomes non-conducting and the $\overline{BP}$ waveform is no longer coupled to the segment switch. Furthermore, the inactivating switch $Q_{2i}$ becomes conducting and connects the segment i to the back plane, shorting out any potentials between these elements, and inactivating that segment in the display.

Figure 4:
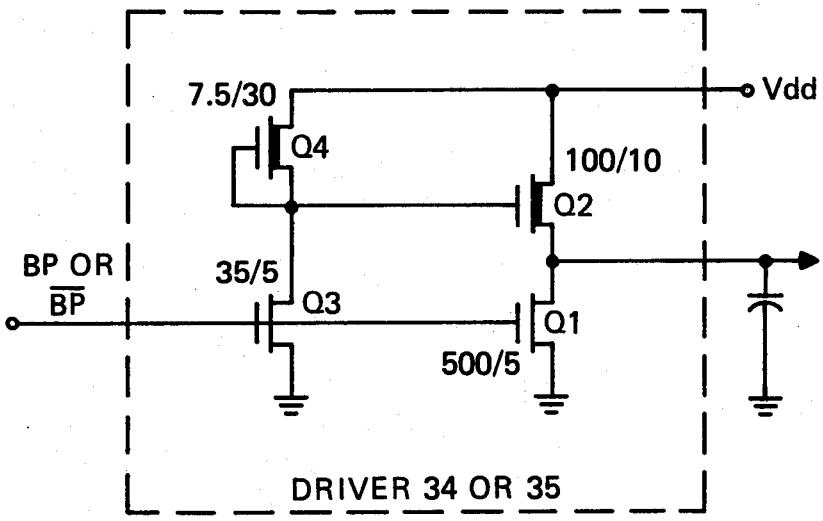
FIG. 4 is a circuit diagram of one of the two principal drivers for the display.

The circuit of the inverting drivers (34, 35) are the same and are as shown in FIG. 4. The drivers are push-pull depletion mode drivers, each utilizing a four active device circuit further subdivided into two series circuits connected between the Vdd bus and the Vss bus (ground) of the IC. The first series circuit consists of the output device Q1, a 500/5 geometry device designed for enhancement mode operation. The source of Q1 is connected to the Vss terminal and the drain is connected to the source of a second, depletion mode FET Q2 of 100/10 geometry. The drain of Q2 is connected to the Vdd terminal. The output of the driver is derived from the interconnection between the drain of Q1 and the source of Q2. The driver further comprises a second series circuit also connected between the Vdd bus and the Vss bus (ground). The second series circuit comprises a third enhancement mode FET Q3 of 35/5 geometry having its source connected to the Vss terminal and its drain connected to the source of a fourth, depletion mode FET, Q4. FET Q4 has its drain connected to the Vdd bus and its gate connected to its source. It has a 7.5/30 geometry. The interconnection between Q3 and Q4 is coupled to the gate of Q2. The waveform $\overline{BP}$ (or BP) is connected to the gate of Q3 which in turn is connected to the gate of Q1.

The input of the driver, which is operated in a digital fashion by the $\overline{BP}$ (BP) waveform swings between near Vdd and zero while the output, which is inverted, also swings between near zero and near Vdd.

Assuming that a negative voltage (−V) in waveform BP ($\overline{BP}$) is coupled to the gates of Q1, Q3; Q3 is on, causing the potential on its drain to approach 0 volts, and Q1 is on, causing the buffer output potential to approach 0 volts. Device Q4 is always on at least weakly, and Q2 is always on. Conduction in Q2 is weak without extra gate drive, i.e., weak while the gate is equal to the source potential.

When the BP ($\overline{BP}$) waveform is at a positive voltage (0 V), Q1 and Q2 turn off allowing the source of Q1 and the drive output to change toward Vdd (−14 V). FET Q4, conducting weakly drives, in a negative sense, driving the gate of Q2 more negatively, causing Q2 to conduct more strongly. The effect is to cause the voltage at the driver output to switch rapidly from near 0 volts toward Vdd (−14 volts). The effect of the geometry selection is to provide a configuration which switches with rapid transitions and which approaches both Vdd and Vss in its output states, while sustaining a relatively high load current in either high or low state. The driver is proportioned to drive the liquid crystal display 14, which is typically represented as a 5000 picofarad capacitor, paralleled with a resistor representing dielectric leakage resistance measured in megohms (decreasing with age).

The appearance of a dc component during ac operation, which shortens the life of the display and increases the leakage, is avoided by use of the present driving circuitry will now be explained with reference to FIGS. 3B and 3C.

Figure 3B:
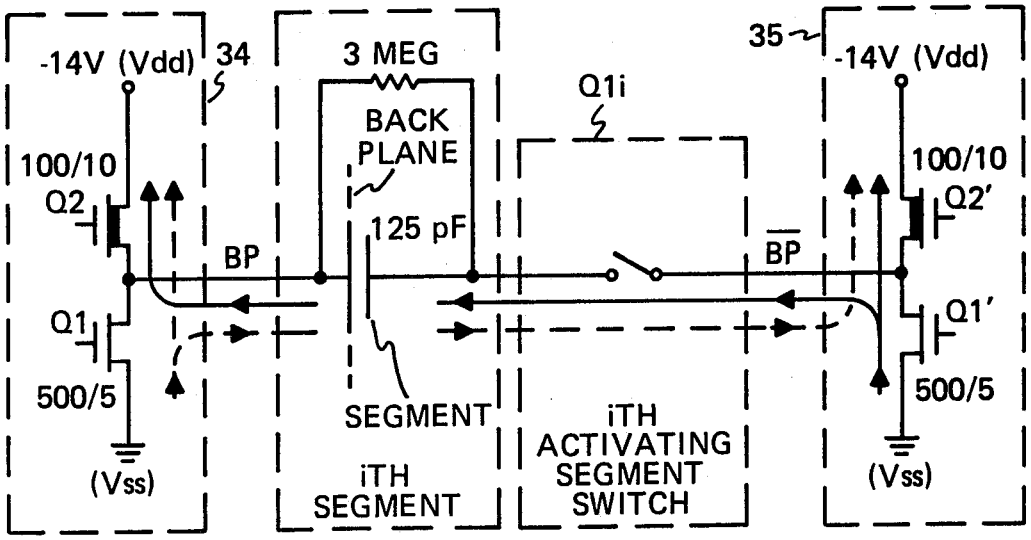
Figure 3C:
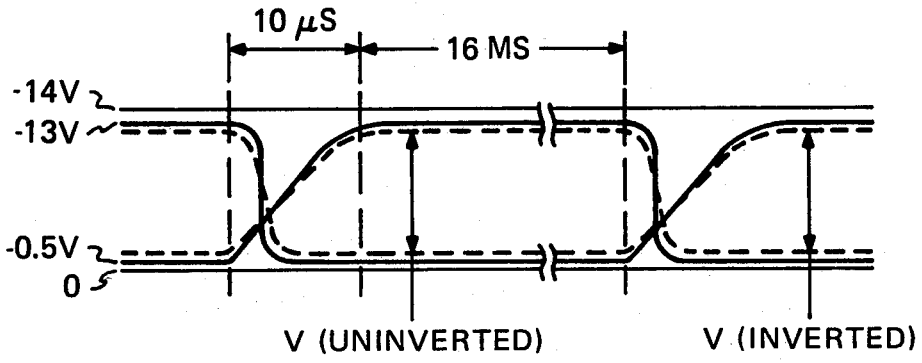
Figure 3D:
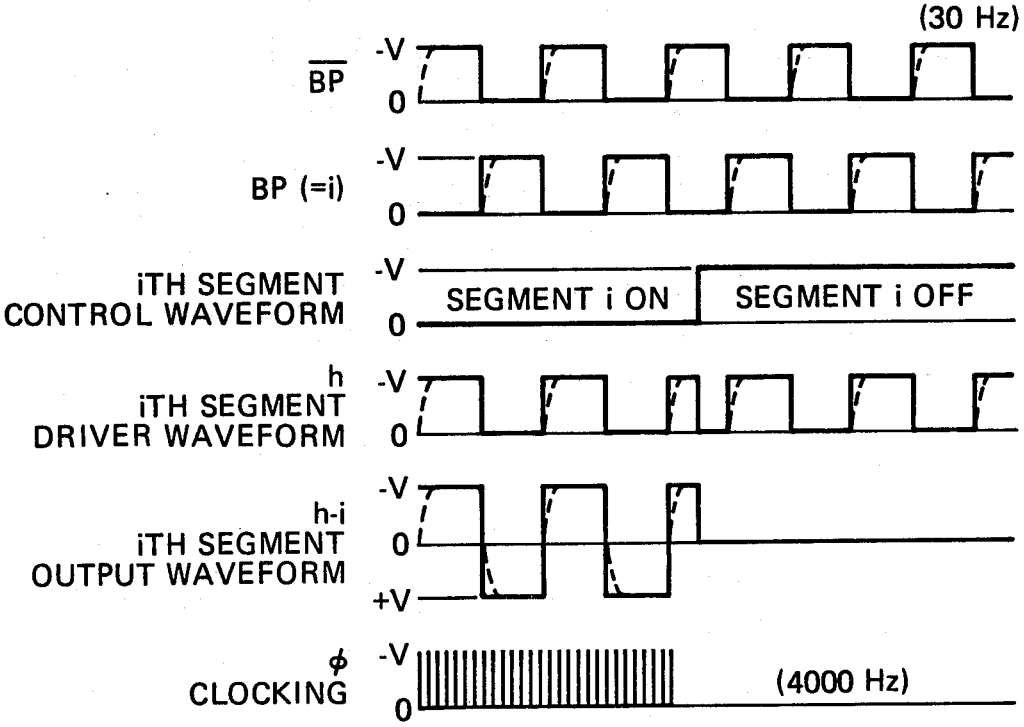

FIG. 3B shows the output stages of the two drivers 34 and 35 in association with the activating segment switch $Q_{1i}$, and an equivalent circuit representation of the $i^{th}$ segment. The output stage of the driver 34 includes the enhancement mode FET Q1 and depletion mode FET Q2 serially connected between ground potential (Vss) and −14 volts (Vdd), with the output being taken at their interconnection, and coupled to the back plane connection of the display. The output stage of the buffer 35 includes the enhancement mode FET Q1′ and depletion mode FET Q2′, serially connected between ground and the Vdd bus. The output of buffer 35 is taken from the interconnection of Q1′ and Q2′ and coupled via the $i^{th}$ activating segment switch $Q_{1i}$, equivalently represented as a single pole, single throw switch to the $i^{th}$ segment of the display. The segment is thus illustrated as a capacitor, whose electrodes are that portion of the back plane capacitively coupled to the segment and a shunting resistance. The value of the capacitance of a single segment is typically 125 picofarads and at a typical half life of the display the shunt resistance is 3 megohms per segment. The capacitance tends to be relatively stable with aging, while the resistance decreases significantly with aging, any direct current applied to the display degrades the visual clarity of the display, causing in part the "plating" out of otherwise mobile polymeric molecules. In short, experience has shown the need to provide ac excitation of the LCD display, and the need to take additional steps to hold any dc component to a minimum.

The foregoing circuit exhibits very precise balance between the forward and reverse excitation, irrespective of the number of segments illuminated. The principal element not balanced is the small interval of approximately 10 microseconds during which switching transients takes place between 30 hertz intervals, the latter intervals lasting 16 milliseconds. Thus, as a percentage of time, the interval of possible mismatch is 10/16,000, or less than 0.1%. Each switching waveforms has substantial symmetry in approaching Vdd and Vss, so that the assymmetry between the uninverted and inverted average voltage is not great. In short, this element of possible asymmetry that might contribute to an average dc affect is properly neglected.

In the 16 millisecond stable intervals, it is essential that the uninverted voltage be precisely equal to the inverted voltage. How this is achieved is explained with reference to FIG. 3C. As seen in FIG. 3B, the devices Q1 and Q1′ conduct alternately, and the devices Q2 and Q2′, which always conduct at least slightly, have periods of increased conductivity, which are also mutually alternate. Assuming that Q1′ is on the principal current flows out of ground into Q1′, via $Q_{1i}$, the $i^{th}$ segment, and into Q2 to the Vdd bus. The segment (assuming only one segment is on) is clamped to near 0 as seen by the solid line nearest and immediately (−0.5 V) above 0 volts. The back plane is held to a voltage near, but greater than Vdd Q1 being non-conducting with Q2 completing the current path. As noted earlier, Q2 tends to be turned on harder at this interval, and the potential may be (−13 V) about a volt above the −14 V Vdd supply. Thus the average uninverted voltage is approximately 12.5 volts during this interval for one segment excitation.

In the next interval, when the inverted waveform occurs, the current path is much like the earlier one. Q1 is now assumed to be "on" with the principal current flowing out of ground into Q1 via the $i^{th}$ segment, via $Q_{1i}$ into Q2′ to the Vdd bus. The potential of the back plane will now assume a voltage which is now approximately 0.5 volts below ground and the potential of the segment will now assume a potential that is approximately 1 volt above the −14 volt Vdd supply. While it is true that the assumed perfect symmetry only occurs when $Q_{1i}$ (segment switch) and $i^{th}$ equivalent segment are lumped as a single load, in practice, the resistance of $Q_i$ produces a small voltage reduction in both the uninverted and the inverted waveforms, which will not cancel out. This small dc displacement of the LCD display is minimized in the design by providing that the segment switches have suitably high conductivity for carrying the currents associated with a single segment. In practice, the segment switch is of 25/5 geometry, is turned on very hard and has a small resistance in comparison to the segment. The voltage drop is typically about 0.002 volts and the imbalance it causes is smaller than other effects.

The foregoing discussion has indicated that substantial dc balance is maintained between successive segments when only a single segment is involved. The dc balance deteriorates negligibly when all segments are active. The voltage across the segments falls slightly, typically on the order of one-half volt of additional drop, (i.e., 12.5 to 12 volts) and the difference between the uninverted and the inverted waveforms is again attributable to the drop in the activating segment switch. Since the total load presented by a segment is typically 1/35th that of the total display, all segment switches, when all segments are active, have 35 times the capacity of a single switch. In practice, a single switch may be of 25/5 geometry; while all taken together are equal to a switch of 875/5 geometry. Thus, as additional segments are activated, the imbalance is not significantly increased over that occurring in respect to a single segment. As earlier suggested, the activating segment switches, when all are operated, will exhibit only a drop of (0.002) volts, equally present when a smaller number of segments are active.

Figure 5A:
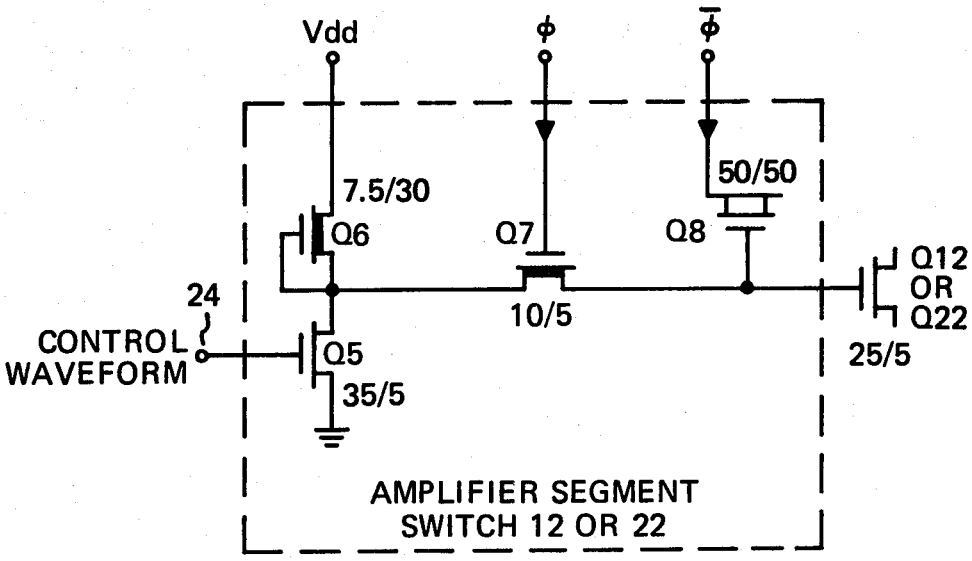
FIG. 5A is an electrical circuit diagram of an amplifier exhibiting voltage doubling, and employed to achieve maximum conductance operation of a segment switch.

In the interests of minimizing chip geometry, since approximately 35 activating segment switches are involved, a voltage doubling amplifier for driving each segment switch is employed, the function of which is to give a very strong gate drive that turns the switches on very strongly. The circuit diagram of a preferred amplifier for driving a segment switch is illustrated in FIG. 5A with waveforms relevant to its operation being illustrated in FIG. 5B. The amplifier circuit entails four devices, Q5, Q6, Q7 and Q8, to which the appropriate segment control waveform is applied. The circuit produces a gate drive of nearly double the Vdd voltage and applies that drive for a duration determined by the segment control waveform. In the doubling process, in phase and out of phase components of the short duration clocking waveform of 14 volts amplitude are employed.

The circuit of the segment switch amplifier is as follows, it being assumed that the segment under discussion is the second segment and that the control waveform is that available on terminal 24 of the clock circuitry (21) of the IC. The terminal 24 containing the segment duration information, is coupled to the gate of an inverter including an enhancement mode FET (Q5) of 35/5 geometry having its source connected to the Vss bus, and its drain connected to the sourcegate of a depletion mode FET (Q6) of 7.5/30 geometry whose drain is connected to the Vdd bus. An inversion of the segment control signal appears at the interconnection between Q5 and Q6 and is coupled to one principal electrode of a depletion mode FET (Q7) having its other principal electrode coupled to the gate of a MOSFET - Capacitor (Q8) of 50/50 geometry and to the gate of the segment switch Q12 or Q22. A short duration, high frequency clocking pulse in a first sense ($\phi$ of FIG. 5B) is coupled to the gate of Q7, while the waveform in opposite sense ($\bar{\phi}$ in FIG. 5B) is coupled to the joint principal electrodes of the MOSFET capacitor Q8. As will now be seen, when the pulses approach the amplitude of the supply Vdd(−14 volts), they will permit the drive applied to Q12 or Q22 to approach 2 Vdd.

Figure 5B:
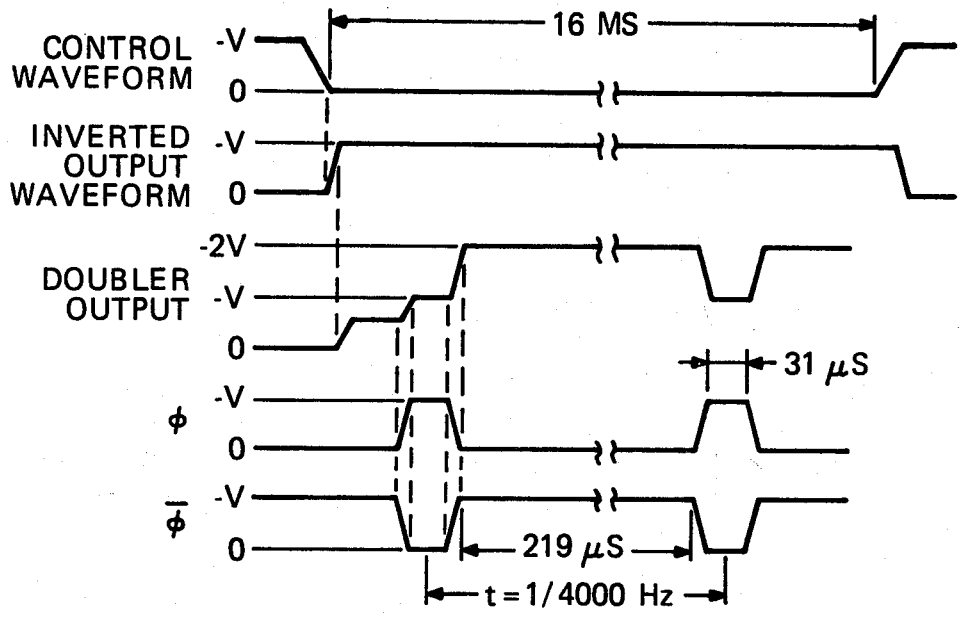
FIG. 5B are waveforms useful in understanding the operation of the segment switch amplifier shown in FIG. 5A.

The operation of the voltage doubling drive will now be explained with reference to the waveforms of FIG. 5B. If the segment duration control (at terminal 24) is at Vdd (−14 V), Q5 will conduct, and the output of the inverter will be near Vss (0 V). If the 4000 hz clocking waveform $\phi$ at the gate of Q7 is at Vss (0 V) and $\phi$ is at Vdd (−14 V), this condition allows Q7 (a depletion mode device) to conduct. Conduction by Q7 causes the output of the amplifier applied to the gate of the switch to be at Vss. The capacitor (Q8) is at minimmum capacity because with zero volts on its gate, it has no charge on its gate, causing the area under the gate region to be non-conducting and precluding its acting as a high capacity.

From the initial condition noted above, the first step in the doubling action occurs when the control waveform at terminal 24 goes to Vss (0 V). This turns off Q5, and the inverter output goes to Vdd (−14 V). Transistor Q7, still conducting, causes the doubler output to drop (perhaps halfway) toward Vdd, the voltage drop is maintained constant as Q7 becomes non-conducting. The appearance of a negative voltage on the gate of FET capacitor Q8 activates its higher capacitance state by causing the channel region under Q8's gate to become conductive, and doubling action is now possible as $\phi$ and $\bar{\phi}$ cycle at 4000 hertz.

With FET capacitor Q8 in its high capacitance state, doubling action occurs with the clocking waveform providing the energy. Assume that $\phi$ changes to Vdd (−14 V) and $\bar{\phi}$ to Vss (0 V), with FET Q7 again becoming conductive, the doubler output climbs to approximately Vdd (−14 V). The FET capacitor Q8 now is charged to Vdd with one terminal supplied with $\phi$ at (0 V) and the other terminal at the instantaneous double output Vdd (−14 V).

In the next state of the clocking waveform, $\phi$ charges to Vss (0 V) and $\bar{\phi}$ to Vdd (−14 V). This action cuts off Q7, and the negative (−14 V) voltage across FET capacitor Q8 added to the negative voltage (−14 V) on the $\bar{\phi}$ bus drives the doubler output to near 2 Vdd (−28 V). This voltage is then available to turn on the segment switches ($Q_{1i}$, $Q_{2i}$) to a highly conductive state. The doubler output is renewed once each pulse (219$\mu$s) and the energy available is adequate to keep the output at near 2 Vdd while $\bar{\phi}$ is negative.

Figure 6:
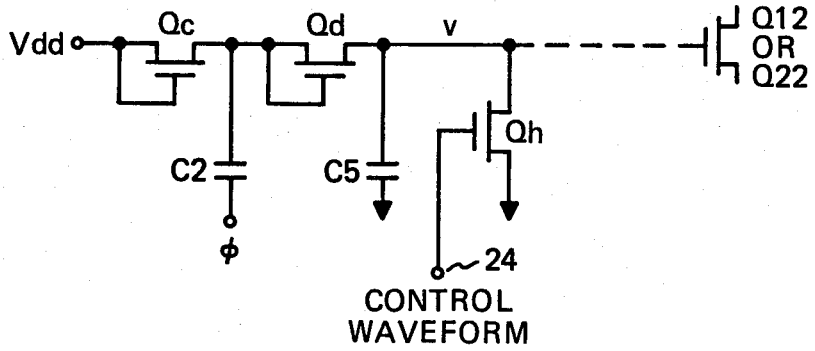
FIGS. 6 and 7 are optional amplifiers for operating the segment switches.
Figure 7:
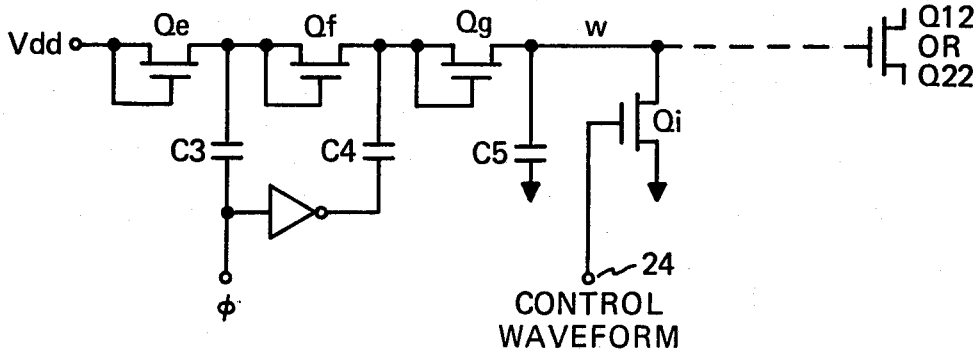

The amplifiers for the segment switches may take the preferred form illustrated in FIG. 5A or the alternate forms shown in FIGS. 6 and 7. In the FIG. 6 embodiment, the circuit operates as a doubler, while in the FIG. 7 arrangement, tripling occurs.

The principal embodiment of the invention and the illustrated waveforms contemplate the use of p-channel devices (PMOS) with Vdd being negative. Generally, the substrate connections have not been shown so that the drawings will equally apply to an NMOS if Vdd is positive. The waveforms, however, (FIGS. 3C, 3D and 5A) imply PMOS operation but in general, the waveforms may also be corrected for NMOS operation by merely adjusting the voltage polarities of the waveforms.

What is claimed is:

1. An integrated circuit for operating a liquid crystal display having plural segments operating in conjunction with a common backplane, comprising:

A. a first and a second terminal for connection to a bias supply suitable for field effect transistor (FET) operations, the second terminal being connected to a source bus for application of a supply reference potential (Vss), and the first terminal being connected to a drain bus for application of the supply potential (Vdd);

B. an n-fold plurality of output terminals for connection to individual segments of the display;

C. an output terminal for connection to the backplane of the display;

D. first and second larger capacity FET drivers of like conductivity polarity, each FET driver having an input terminal for connection to a periodic input signal, and an output terminal at which a periodic output appears, alternating between near supply and near reference potentials under load, each FET driver consisting of an output FET having its principal electrodes connected between said driver output terminal and said second supply terminal; and an internal driver load connected between said first supply terminal and said driver output terminal;

E. the output terminal of the first driver being connected to said backplane terminal;

F. means for coupling an alternating signal to the input of said first and second drivers, said last recited signal being coupled to said first driver in a phase inverse to that coupled to said second driver to establish an alternating potential between the output terminals of said drivers;

G. an n-fold plurality of FET segmental switching means having lower capacity than said drivers for activating each segment by disconnecting each segment from said backplane and by connecting each segment to said second driver output terminal; and for inactivating each segment by connecting each segment to said backplane and by disconnecting each segment from said second driver output terminal;

said arrangement minimizing the dc component applied to active display segments and suppressing any ac or dc component applied to inactive display segments.

2. An integrated circuit for operating a liquid crystal display as set forth in claim 1, wherein A. said segments in associated with an adjacent portion of said back plane, individually exhibit a small capacity shunted by a large valued shunt resistance, and collectively represent a larger capacity also shunted by a large valued shunt resistance;

B. said first and second higher capacity driver being proportioned to operate said segments collectively; and C. said lower capacity segmental switching means for connecting and disconnecting said segment from said second driver being proportioned to operate individual segments.

3. An integrated circuit as set forth in claim 2, wherein:

the switching means associated with each segment comprises a pair of FET switches, the first member of the pair connected between the segment and said output terminal of said second driver stage, and the second member of the pair being connected between the segment and said back plane.

4. An integrated circuit as set forth in claim 3 wherein said first and second FET drivers are push-pull depletion mode drivers, each comprising:

A. a first, series circuit connected between said first and second supply terminals, wherein:

(i) said output FET is a first, enhancement mode FET, and (ii) said driver load is a second, depletion mode FET;

B. a second series circuit connected between said first and second supply terminals, comprising:

(i) a third enhancement mode FET having the source connected to said second supply terminal, and (ii) a fourth, depletion mode FET having the drain connected to said first supply terminal and the source and gate connected to the drain of said third device, said first, second, third and fourth FETs being of like conductivity polarity, C. means connecting the gate-source connection of said first FET to the gate of said second FET, D. said driver input terminal being connected to the gates of said first and third FETs for coupling said alternating signal to said driver.

5. An integrated circuit as set forth in claim 4 wherein:

A. said first member of each pair of switching means comprises a fifth, enhancement mode FET, the principal electrodes thereof being connected between the output terminal of said second driver and a segment; and B. said second member of said pair of switching means comprises a sixth, enhancement mode FET, the principal electrodes thereof being connected between said back plane and said last recited segment, said fifth and sixth FETs being of said like conductivity polarity.

6. An integrated circuit as set forth in claim 5 having in addition thereto:

A. means for generating a binary segment control signal for setting each segmental switching means in accordance with a desired display function, B. means for supplying a clock signal having a voltage of the same polarity and of a magnitude comparable to that of said bias supply, having an in-phase and out-of-phase component, and wherein C. a voltage doubling control amplifier is provided for each FET segment switch comprising:

(i) an inverter including a seventh, enhancement mode FET having a first principal electrode connected to said second supply terminal, an eighth depletion mode FET, acting as a current conducting load for said seventh FET, having a first principal electrode connected to said first supply terminal, the second principal electrode being connected to the second principal electrode of said seventh FET, the gate of said seventh FET being connected to said segment control generating means for switching said seventh FET between conductive and non-conductive states;

(ii) a ninth, depletion mode FET having the first principal electrode connected to the second principal electrode of said seventh device and the second principal electrode connected to the gate of an FET segment switch;

(iii) a tenth, variable capacitance FET having its principal electrodes interconnected, the charge storage property thereof arising upon application of a potential of appropriate sense between said principal electrodes and the gate, the effective capacity being proportional to such applied potential, the gate thereof being coupled to the second principal electrode of said ninth FET, and F. said in phase clocking component being 40 coupled to the gate of said ninth FET, and said out-of-phase clocking component being coupled to the principal electrodes of said FET capacitor, said arrangement producing an enhanced gating signal for said FET segment switches representing an approximate addition of the bias and clocking potentials.

* * * * *